US009982887B2

(12) United States Patent
Gangale

(10) Patent No.: US 9,982,887 B2
(45) Date of Patent: May 29, 2018

(54) BURNER

(71) Applicant: WORGAS BRUCIATORI S.R.L., Formigine (IT)

(72) Inventor: Gabriele Gangale, Formigine (IT)

(73) Assignee: WORGAS BRUCIATORI S.R.L., Formigine (IT)

( * ) Notice: Subject to any disclaimer, the term of this patent is extended or adjusted under 35 U.S.C. 154(b) by 260 days.

(21) Appl. No.: 14/922,925

(22) Filed: Oct. 26, 2015

(65) Prior Publication Data

US 2016/0123578 A1 May 5, 2016

(30) Foreign Application Priority Data

Nov. 5, 2014 (IT) ..... MI14A1890

(51) Int. Cl.

| | |
|---|---|
| ***F23D 14/02*** | (2006.01) |
| ***F23D 14/14*** | (2006.01) |
| ***F23D 14/58*** | (2006.01) |
| ***F23D 14/70*** | (2006.01) |

(52) U.S. Cl.

CPC ..... *F23D 14/02* (2013.01); *F23D 14/14* (2013.01); *F23D 14/58* (2013.01); *F23D 14/70* (2013.01); *F23D 2900/14701* (2013.01)

(58) Field of Classification Search

CPC ..... F23D 14/58; F23D 14/62; F23C 5/00
USPC ..... 431/328, 8, 174, 12; 126/39 E
See application file for complete search history.

(56) References Cited

U.S. PATENT DOCUMENTS

| | | | | |
|---|---|---|---|---|
| 3,857,670 | A * | 12/1974 | Karlovetz | D06F 67/02 431/329 |
| 9,383,093 | B2 * | 7/2016 | Tilmont | E21B 36/02 |
| 9,739,483 | B2 * | 8/2017 | Akbarimonfared | F23D 14/08 |
| 9,810,427 | B2 * | 11/2017 | Fernandes | F23D 14/02 |
| 9,816,726 | B2 * | 11/2017 | Le Mer | F24H 1/145 |
| 2003/0096204 | A1 * | 5/2003 | Hermann | F23C 13/00 431/7 |
| 2004/0255589 | A1 * | 12/2004 | Yoshida | F23R 3/286 60/746 |
| 2008/0268387 | A1 * | 10/2008 | Saito | F23R 3/286 431/8 |
| 2010/0291495 | A1 * | 11/2010 | Scribano | F23D 14/105 431/174 |
| 2010/0316965 | A1 | 12/2010 | Le Mer et al. | |

(Continued)

FOREIGN PATENT DOCUMENTS

| | | |
|---|---|---|
| EP | 2 037 175 A2 | 3/2009 |
| WO | 2012/069534 A1 | 5/2012 |

OTHER PUBLICATIONS

International Search Report dated Jun. 25, 2015.

*Primary Examiner* — Gregory Huson
*Assistant Examiner* — Nikhil Mashruwala
(74) *Attorney, Agent, or Firm* — Arent Fox LLP; Michael Fainberg

(57) ABSTRACT

A burner comprises a tubular diffuser wall and an inlet passage a flow of a mixture of gas within the diffuser wall, as well as a first diaphragm arranged in the inlet passage, said diaphragm forming a plurality of through openings and a plurality of guide surfaces delimiting the through openings on a radially outer side thereof so that, when introducing the mixture, said guide surfaces and said through openings direct the mixture towards the inside of the burner and in a radial direction towards the longitudinal axis.

10 Claims, 4 Drawing Sheets

(56) References Cited

U.S. PATENT DOCUMENTS

| | | | | |
|---|---|---|---|---|
| 2015/0330623 | A1* | 11/2015 | Beaber | F23D 14/18 431/328 |
| 2016/0102858 | A1* | 4/2016 | Acocella | F23D 14/58 431/354 |
| 2016/0238243 | A1* | 8/2016 | Gilioli | F23D 91/02 |
| 2017/0122555 | A1* | 5/2017 | Owens | F23D 14/145 |

* cited by examiner

BURNER

BACKGROUND

The present invention relates to a gas burner for a boiler and for industrial applications, of the type comprising:

- a support wall connectable to a combustion chamber of the boiler or industrial application, the support wall having an inlet opening for introducing a mixture of fuel gas and oxidant into the burner,
- a tubular diffuser wall having a first end connected to the support wall in flow communication with the inlet opening, a second end closed by a closing bottom, and a perforation for the passage of the mixture of gas from the inside of the burner to an outer side of the diffuser wall, where the combustion occurs,
- a tubular element positioned inside the diffuser wall and having a base connected to the support wall in flow communication with the inlet opening and a free end forming an outlet opening in an intermediate position between the first end and the second end of the diffuser wall.

This known burner is described in patent application WO2009/112909 by the Applicant and aims at overcoming problems of noise of the previously known cylindrical burners. By virtue of the tubular element in the burner, the resonance frequency of the burner can be modified and the vibration frequencies induced during the operation can be moved away from the resonance frequencies of the burners, thus reducing the noise thereof and the cyclical mechanical stress caused by the vibrations themselves.

However, the burners provided with the "noise-reducing" tubular element display a non-uniform flame distribution on the outer surface of the diffuser, thus preventing optimal exploitation of the size of the burner for heat generation purposes.

Finally, the local heating of the diffuser wall caused by the presence of the "noise-reducing" tubular element causes a high risk of flashback of the fuel-oxidant mixture still upstream of the diffuser wall.

It is the object of the present invention to provide a gas burner of the above-described type, but modified so as to overcome the observed drawbacks of the prior art.

SUMMARY

In the scope of the general purpose, it is a particular purpose of the invention to:

- improve the known burner so as to keep noise reduced, and in particular to eliminate the onset of whistling which may be attributed to vibrations in the coupling of the gas valve to the burner, and at the same time,
- improve flame and combustion uniformity and stability, and
- reduce the risk of local overheating of the diffuser wall.

These and other objects are achieved by means of a burner, comprising:

- a support wall connectable to a combustion chamber of the boiler or industrial application, said support wall forming an inlet passage for introducing a mixture of fuel gas and oxidant into the burner,
- a tubular diffuser wall, coaxial to a longitudinal axis of the burner and having a first end connected to the support wall in flow communication with the inlet passage, a second end closed by a closing bottom, and a perforation for the passage of the gas mixture from the inside of the burner to an outer side of the diffuser wall, where the combustion occurs, a diaphragm substantially concentric with the longitudinal axis and arranged in the inlet passage, said diaphragm forming a plurality of through openings and a plurality of guide surfaces defining the through openings on a radially outer side thereof (with respect to the longitudinal axis), so that, in the direction of introduction of the mixture, said guide surfaces and said through openings direct the mixture towards the inside of the burner and in the radial direction towards the longitudinal axis.

By virtue of the guide surfaces on the radially outer side of the through openings, the flow of gas mixture during its introduction into the burner is diverted radially inwards, which basically determines a concentric axial flow along the longitudinal axis of the burner. Near the closing bottom, the flow thus "compacted" is sent back and "widened" radially outwards to extend in axially uniform manner along the inner surface of the diffuser wall.

The performed tests have indicated a causal relationship between the presence and shape of the guide surfaces associated to the through openings and lesser noise, in particular with reference to the aforesaid whistling, as well as greater flame stability and uniformity and lower local overheating tendency of the diffuser wall.

BRIEF DESCRIPTION OF THE DRAWINGS

In order to better understand the invention and appreciate its advantages, some non-limitative embodiments will be described below with reference to the drawings, in which.

DETAILED DESCRIPTION

Figure 1:
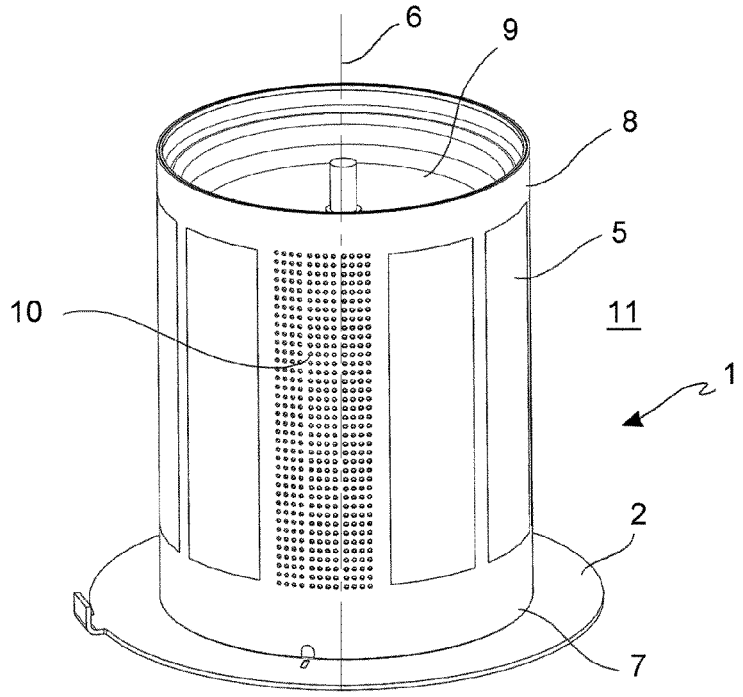
FIG. 1 is a perspective view of a burner according to an embodiment.
Figure 2:
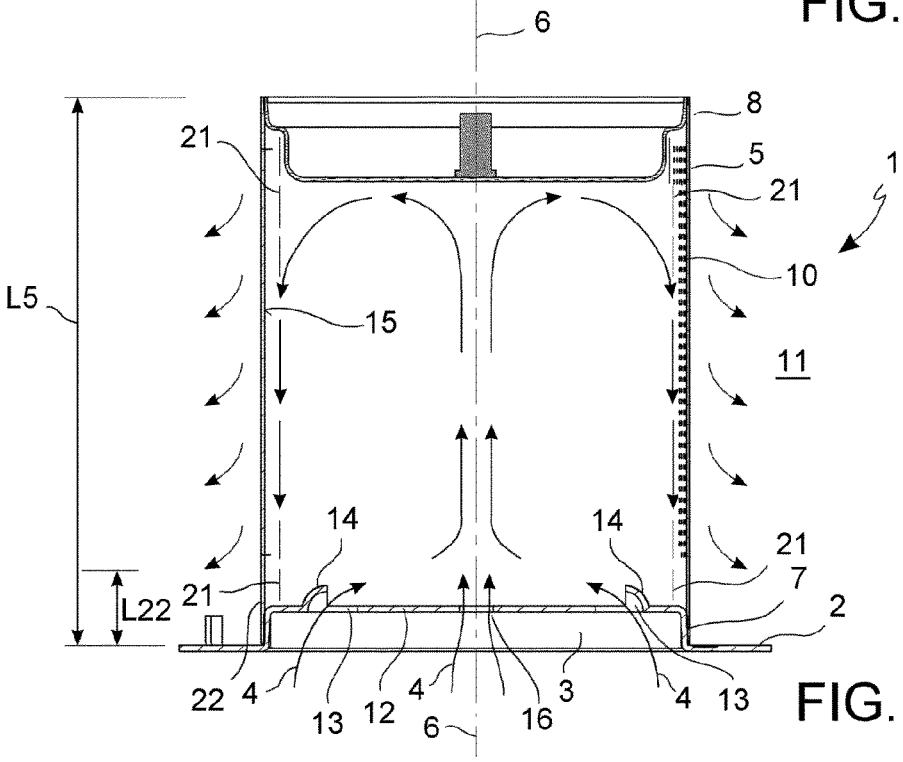
FIG. 2 is a longitudinal section view of the burner in FIG. 1 taken along a section plane radial to the longitudinal axis of the diffuser.
Figure 3:
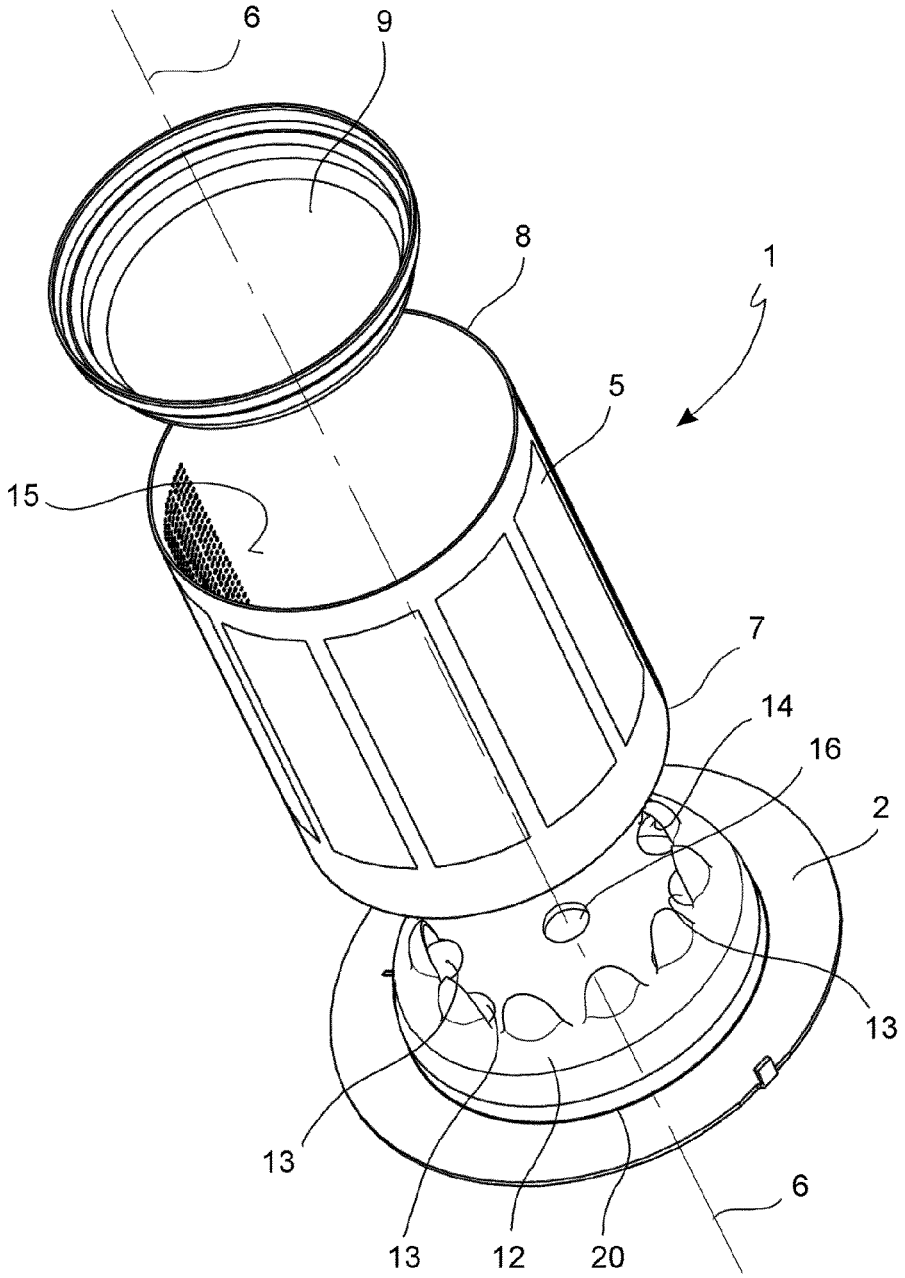
FIG. 3 is an exploded perspective view of the burner in FIG. 1.
Figure 4:
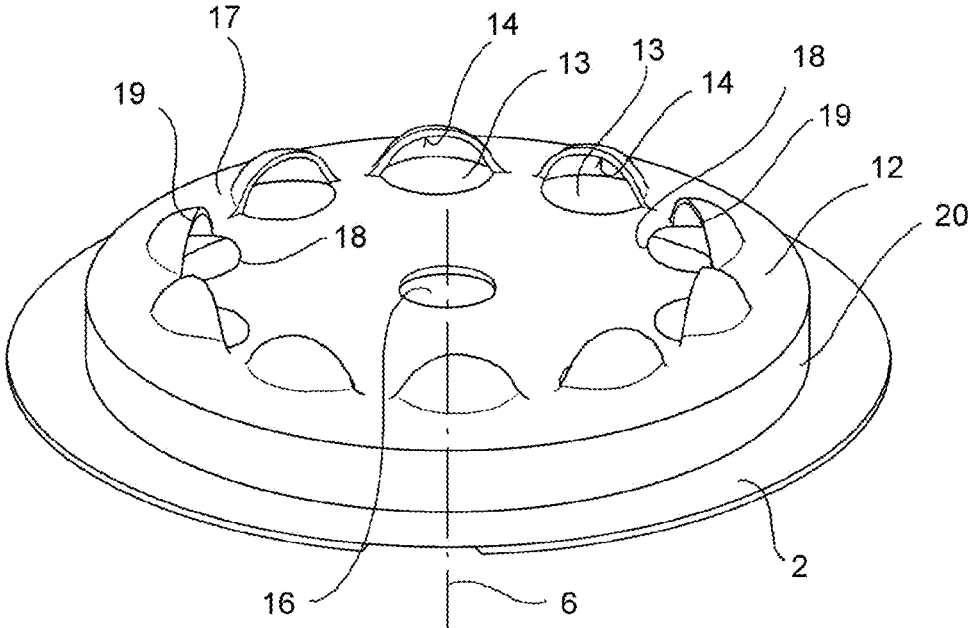
FIG. 4 is a perspective view of a diaphragm of the burner according to an embodiment.
Figure 5:
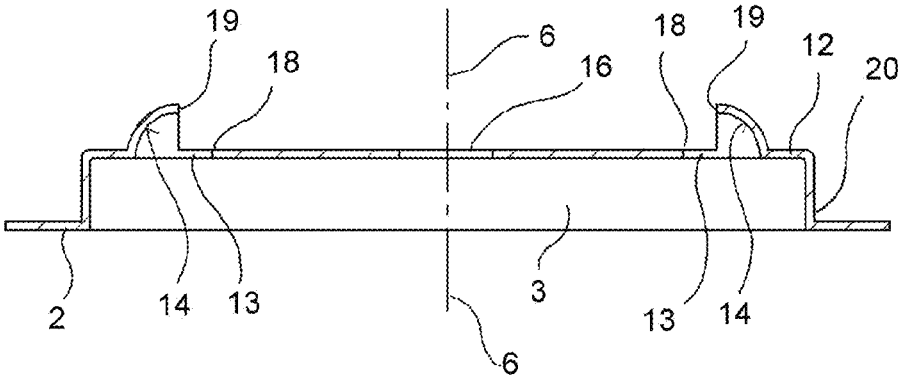
FIG. 5 is a view taken along a radial section plane of the diaphragm in FIG. 4, FIG. 6 diagrammatically shows the flow conditions obtained by means of a burner according to the invention.
Figure 6:
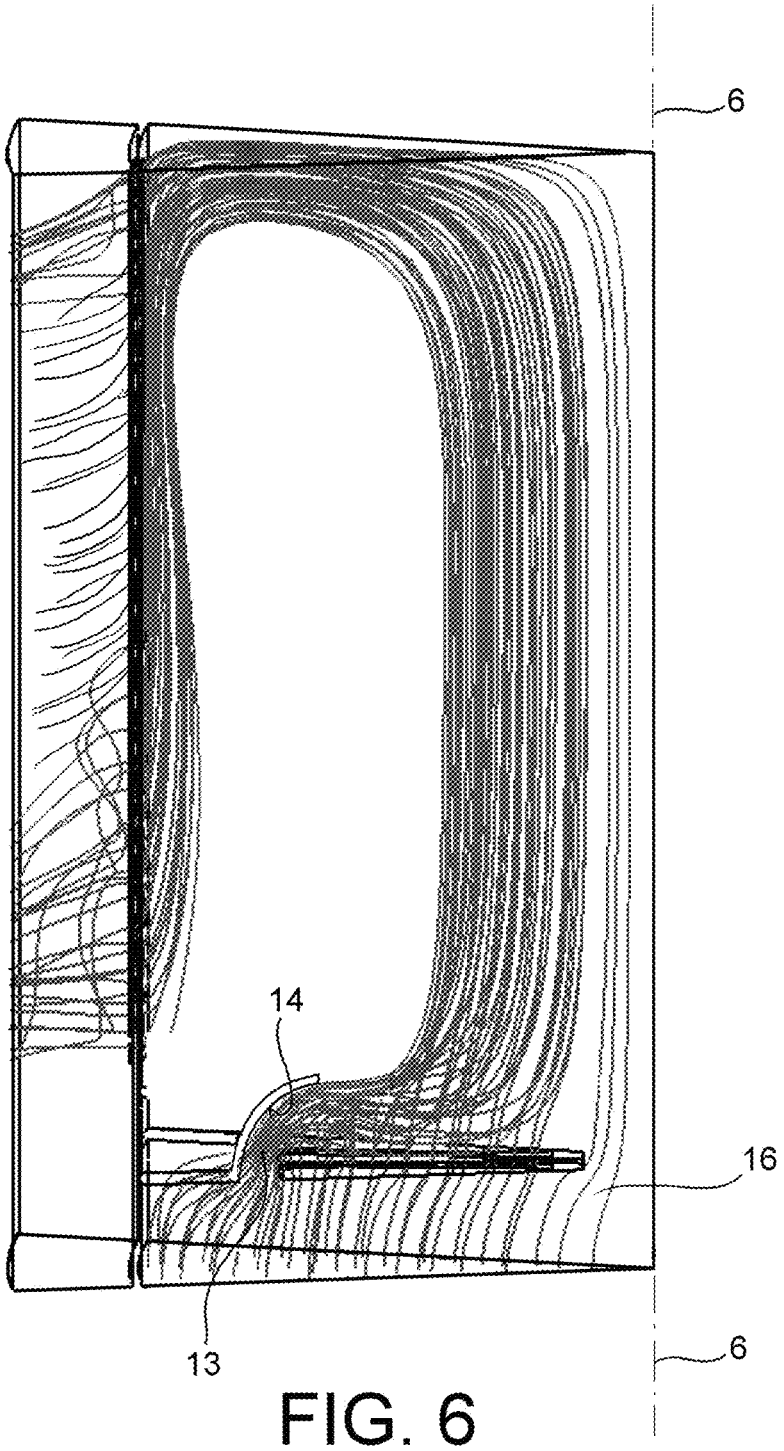

With reference to the figures, a gas burner for boilers or industrial applications, which produces heat by means of the combustion of a fuel gas in general or of a premixture of fuel gas and air in particular, is indicated as a whole by reference numeral 1. Burner 1 comprises a support wall 2 connectable to a combustion chamber of the boiler or industrial application, the support wall 2 forming an inlet passage 3 for introducing a mixture 4 of fuel gas and oxidant into burner 1.

Burner 1 further comprises a diffuser wall 5, which is tubular and coaxial with respect to a longitudinal axis 6 of burner 1 and having a first end 7 connected to the support wall 2 in flow communication with the inlet passage 3, a second end 8 closed by a closing bottom 9, and a perforation 10 for the passage of the gas mixture 4 from the inside of burner 1 to an outer side 11 of the diffuser wall 5, where the combustion occurs.

According to an aspect of the invention, burner 1 comprises a diaphragm 12 substantially concentric with the longitudinal axis 6 and arranged in the inlet passage 3, said diaphragm 12 forming a plurality of through openings 13 and a plurality of guide surfaces 14 defining the through openings on a radially outer side thereof (with respect to the longitudinal axis 6, so that, during the insertion of mixture 4, said guide surfaces 14 and said through openings 13 direct mixture 4 towards the inside of burner 1 and in the radial (radially inner) direction towards the longitudinal axis 6.

By virtue of the guide surfaces 14 on the radially outer side of the through openings 13, the flow of mixture 4, during its introduction into burner 1, is diverted radially inwards, which basically determines a concentric axial flow along the longitudinal axis 6 of the burner. Near the closing bottom 9, the flow thus "compacted" is sent back and "widened" radially outwards to extend in axially uniform manner along the inner surface 15 of the diffuser wall 5.

The performed tests have indicated a causal relationship between the presence and shape of the guide surfaces 14 associated to the through openings 13 and lesser noise, in particular with reference to the aforesaid whistling, as well as a greater flame stability and uniformity and a lower local overheating tendency of the diffuser wall 5.

According to an embodiment, diaphragm 12 is made of metal sheet, preferably steel.

Diaphragm 12 is substantially planar and substantially orthogonal to the longitudinal axis 6.

Alternatively, diaphragm 12 may have a bulging shape, e.g. a flattened dome shape or with circumferential steps with respect to the longitudinal axis 6. Preferably, the shape of diaphragm 12 is substantially symmetric with respect to the longitudinal axis 6.

In a preferred embodiment, the pattern of the through openings 13 and the distribution of the guide surfaces 14 are symmetric with respect to the longitudinal axis 6.

In an embodiment, the through openings 13 are formed in a radially outer portion 17 of diaphragm 12 and are advantageously arranged in one or more circumferential sequences (e.g. of 6, 8, 10 or 12, preferably 10 individual openings) with respect to the longitudinal axis 6.

The through openings 13 have a radially inner edge 18 (with respect to the longitudinal axis 6) extending on a plane substantially orthogonal to the longitudinal axis 6 and a radially outer edge 19 extending in a plane inclined or parallel to the longitudinal axis 6, wherein the outer edge 19 forms a free outlet end of the guide surfaces 14. In this manner, a radially inner region of the through openings 13 allows a passage of flow of mixture in a direction substantially parallel to the longitudinal axis 6 and in radially outer region of the through openings 13 determines a flow of mixture in a direction radial to the longitudinal axis 6, which pushes the mixture which entered into the radially inner region of the opening in the radial direction as well.

In one embodiment, the guide surfaces 14 may have the shape of a spherical or oval half-dome or of a segment of a spherical or oval dome so that the outer edge is arc-shaped, e.g. shaped as an arc of a circle.

In an alternative embodiment, the guide surfaces 14 are shaped as a segment of a cylindrical or frusto-conical tube, suitable to direct the mixture in a radially inward direction.

Advantageously, the guide surfaces 14 are formed radially externally to the through openings 13 and bulging towards the inside of burner 1. In other words, the guide surfaces 14 are concave.

In one embodiment, diaphragm 12 further comprises a central hole 16 concentric with the longitudinal axis 6 and having a passage area smaller than the total passage area of the through openings 13 in the radially outer portion 17 of diaphragm 12.

The presence of the central hole 16 provides a partial mixture flow along the longitudinal axis 6 which forms a "guide" along which the flow diverted outwards converges and which stabilizes it. Such a central hole 16 implies a further surprising lowering of the noise of burner 1.

Advantageously, the central hole 16 is formed on a plane orthogonal to the longitudinal axis 6, in such a manner to address a partial flow of mixture 4 in a direction parallel and concentric to the longitudinal axis 6.

Diaphragm 12 may be formed in one piece with the support wall 2 or connected thereto, e.g. by welding or by press-fitting.

In an advantageous embodiment, the support wall 2 is made of metal sheet, e.g. in steel, and forms:

- an outer circumferential seat 20 (circumferential step) facing towards the outside of burner 1 and adapted to accommodate a front edge 7 of the diffuser wall 5,
- optionally, an inner circumferential seat 21 (circumferential step) facing towards the inside of burner 1 and adapted to accommodate an outer edge (not shown) of diaphragm 12 and to ensure a correct positioning thereof,
- optionally, a further outer circumferential seat (circumferential step, not shown) facing towards the outside of burner 1 and adapted to accommodate a front edge of a distributor wall 21.

Advantageously, diaphragm 12 is positioned inside and does not extend beyond an end stretch 22 of the diffuser wall 5 at the support wall 2, in which the axial length L22 of said end stretch 22 is less than one fourth of the axial length L5 of the diffuser wall 5, preferably less than one fifth of the axial length L5 of the diffuser wall 5.

In the preferred embodiment, diaphragm 12 forms the only guide barrier to the mixture flow 4 and the inlet passage 3 of burner 1 is free from further diaphragms or barriers.

According to an embodiment, the diffuser wall 5 consists of a perforated steel sheet and is cylindrical or slightly frusto-conical shaped. Additionally or alternatively, the perforated steel sheet of the diffuser wall 5 may be lined on the outside with an outer layer of mesh or fabric (not shown) made of metallic or ceramic or sintered material, which realizes the outer surface of the diffuser wall 5 on which the combustion occurs.

A distributor wall 21, if provided, may consist of a perforated steel sheet of cylindrical or slightly truncated-cone shape, coaxial with the longitudinal axis 6 and positioned inside the diffuser wall 5.

The burner 1 according to the invention has many advantages, in particular noise reduction, greater flame uniformity and stability and less risk of local overheating of the diffuser wall. The need to provide an additional distributor wall upstream of the diffuser wall 5 can be avoided by virtue of flame uniformity and uniform combustion distribution on the diffuser wall.

Obviously, those skilled in art may make further changes and variations to the burner according to the present invention, all without departing from the scope of protection of the invention, as defined in the following claims.

The invention claimed is:

1. A burner, comprising:

a support wall forming an inlet passage for introducing a mixture of fuel gas and oxidant into the burner, a diffuser wall, which is tubular and coaxial with respect to a longitudinal axis of the burner and having a first end connected to the support wall in flow communication with the inlet passage a second end closed by a closing wall, and a perforation for the passage of the gas mixture from the interior of the burner to an outer side of the diffuser wall where the combustion occurs, a diaphragm substantially concentric with the longitudinal axis and arranged in the inlet passage, said diaphragm forming a plurality of through openings and a plurality of guide surfaces defining the through openings on a radially outer side thereof, so that, during the insertion of the mixture, said guide surfaces and said through openings direct the mixture inwardly of the burner and in the radial direction towards the longitudinal axis; and wherein the guide surfaces are in the form of a segment of a spherical or oval dome.

2. The burner according to claim 1, wherein the diaphragm is substantially planar and substantially orthogonal to the longitudinal axis.

3. The burner according to claim 1, wherein the diaphragm has a bulging shape, a flattened dome shape or with at least one step extending circumferentially with respect to the longitudinal axis.

4. The burner according to claim 1, wherein the shape and distribution of the through openings and the shape and distribution of the guide surfaces are symmetric with respect to the longitudinal axis.

5. The burner according to claim 1, wherein the through openings are formed in a radially outer portion of the diaphragm and arranged in at least one circumferential sequence with respect to the longitudinal axis.

6. The burner according to claim 1, wherein said through openings have a radially inner edge extending in a plane substantially orthogonal to the longitudinal axis and a radially outer edge extending in a plane inclined or parallel to the longitudinal axis, wherein the outer edge forms a free outlet end of the guide surfaces.

7. The burner according to claim 1, wherein the guide surfaces are in the form of a segment of a cylindrical or frusto-conical tube, suitable to direct the mixture in a radially inward direction.

8. The burner according to claim 1, wherein the guide surfaces are formed radially externally to the through openings in wall portions that are bulging inwardly of the burner.

9. The burner according to claim 1, wherein the diaphragm further comprises a central hole concentric with the longitudinal axis and having a passage area smaller than the total passage area of the through openings in the radially outer portion of the diaphragm.

10. The burner according to claim 1, wherein the inlet passage of the burner is free from further diaphragms or barriers.

* * * * *